US008182307B1

(12) United States Patent
Pinkard

(10) Patent No.: US 8,182,307 B1
(45) Date of Patent: May 22, 2012

(54) SPACE STATION TOY (U.S.E.R. CIVIL., A.G.E.S., A.C.T.S., CO.)

(76) Inventor: Joseph A. (M. F.) Pinkard, Far Rockaway, NY (US)

( * ) Notice: Subject to any disclaimer, the term of this patent is extended or adjusted under 35 U.S.C. 154(b) by 325 days.

(21) Appl. No.: 12/700,660

(22) Filed: Feb. 4, 2010

(51) Int. Cl.
*A63H 27/00* (2006.01)

(52) U.S. Cl. ..... 446/230

(58) Field of Classification Search ..... 446/230
See application file for complete search history.

(56) References Cited

U.S. PATENT DOCUMENTS

| | | | | |
|---|---|---|---|---|
| D279,394 | S | 6/1985 | Coleman | |
| 4,573,938 | A * | 3/1986 | Sassak | 446/179 |
| 4,612,741 | A | 9/1986 | Jacobson | |
| 4,894,039 | A * | 1/1990 | Taylor et al. | 446/75 |
| D311,941 | S | 11/1990 | Thomson et al. | |
| 5,310,375 | A | 5/1994 | Kanauchi | |
| 5,326,328 | A | 7/1994 | Robinson | |
| D371,578 | S | 7/1996 | Henderson | |
| D472,588 | S | 4/2003 | Lai | |
| 6,540,580 | B1 | 4/2003 | Wolfram | |
| D474,250 | S | 5/2003 | Herrera | |
| 6,723,025 | B2 | 4/2004 | Rayho | |

* cited by examiner

*Primary Examiner* — Gene Kim
*Assistant Examiner* — Michael Dennis

(57) ABSTRACT

The present invention features a toy artificial planet space station comprising a generally hollow spherical unit, wherein the spherical unit is assembled from a plurality of levels, the levels are interconnected via an interconnecting mechanism and are detachable from each other, the levels are generally circular flat disk shaped and are generally hollow with aquatic avionic continental transformer port circular disk shapes inside each detachable artificial planet hollow level and a landing gear; and a landing gear assembly comprising four legs pivotally attached to the unit near the front end, the leg of the landing gear is operatively connected to motor that can draw in the leg towards the unit or extend the leg away from the unit.

2 Claims, 15 Drawing Sheets

3D TOP VIEW

3D BOTTOM VIEW

3D TOP VIEW

3D BOTTOM VIEW

3D TOP VIEW

3D TOP VIEW

SIDE VIEW

FRONT VIEW

BACK VIEW

BOTTOM VIEW
(LANDING GEAR CLOSED)

BOTTOM VIEW
(LANDING GEAR CLOSED)

TOP VIEW

SEVEN DETACHABLE A.G.E.S., A.C.T.S.,
SECTION – LEVELS

SPACE STATION TOY (U.S.E.R. CIVIL., A.G.E.S., A.C.T.S., CO.)

FIELD OF THE INVENTION

The present invention is directed to a toy designed to resemble a (U.S.E.R.C.A., A.G.E.S., WORLD, ARTIFICIAL-PLANET) space station.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-9, the present invention features a space station toy 100 (e.g., U.S.E.R. CIVIL., A.G.E.S. A.C.T.S. CO.). The A.G.E.S., WORLD space station toy 100 may resemble an artificial planet, a space station, or a space ship. The space station toy 100 may be labeled with a logo such as "Aquatic-Avionic-City-Continental-Transformer Port". SPHERICAL SATELITE SHIP SYSTEM=A.C.T.S. and AQUATIC-AVIONIC-GLOBAL GOVERNMENTAL-EMERGENCY EVACUATORY ENVIRONMENTAL SPHERICAL SATELITE SHIP SYSTEM=A.G.E.S.

The space station toy 100 of the present invention provides a space station/spaceship scenario. The space station toy 100 may provide entertainment and education to a child or other user. The space station toy 100 may promote creativity in children as well as adults. A child or other user can use their imagination to create scenarios in which this toy 100 may be used.

Figure 1:
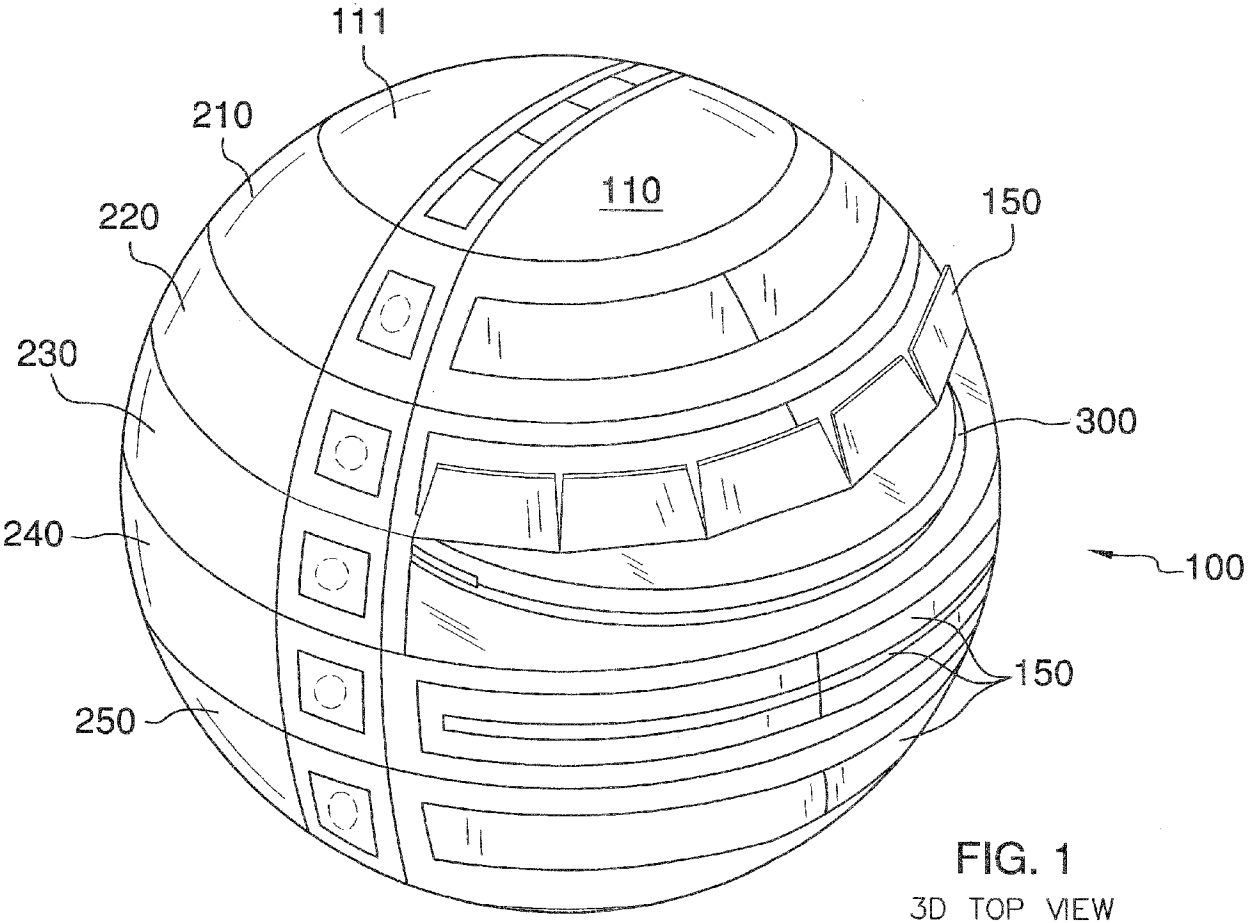
FIG. 1 is a first (top) perspective view of the space station toy of the present invention.
Figure 11:
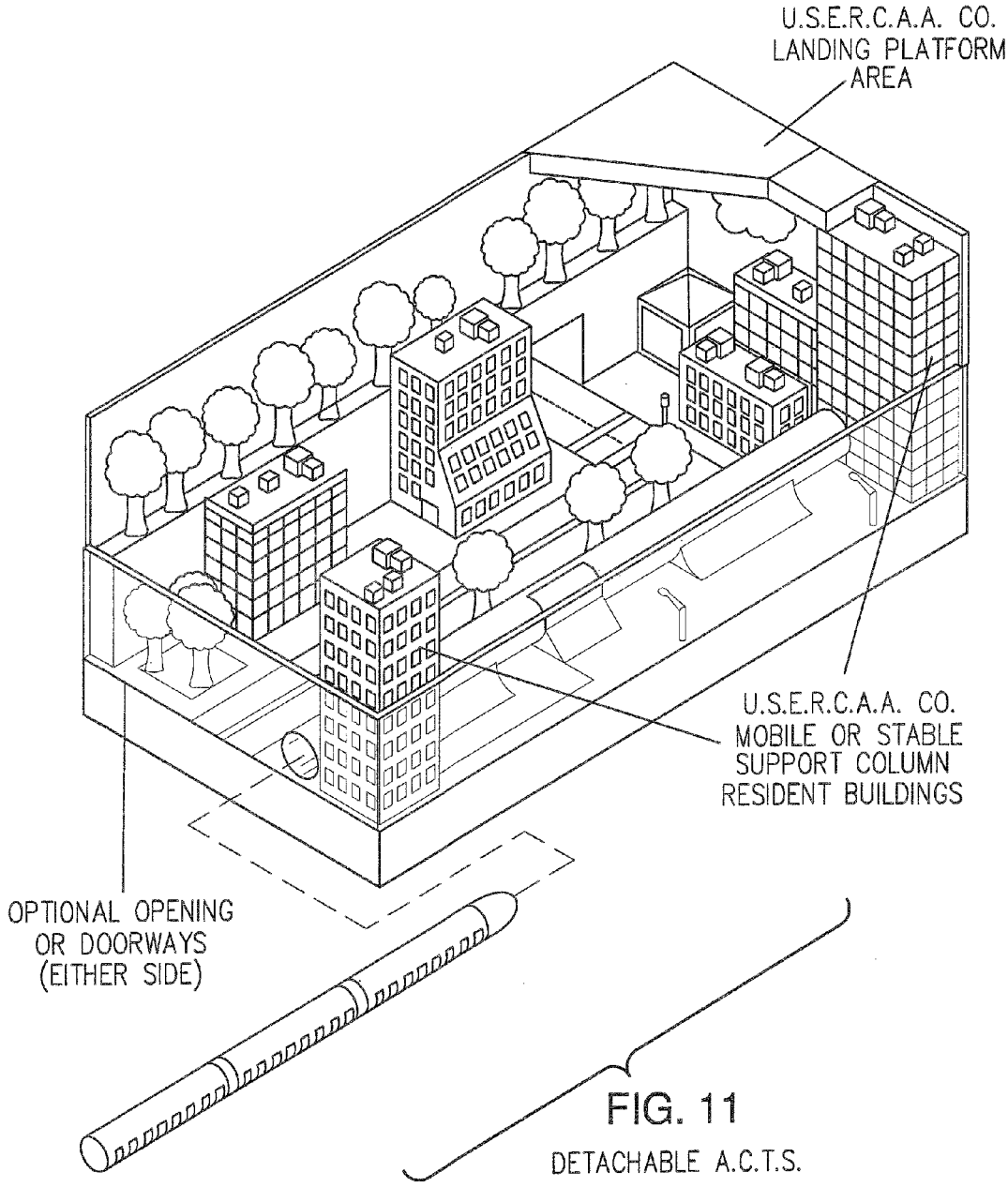
FIG. 11 is a detailed view of the landing platform.

The space station toy 100 comprises a generally hollow spherical rectangular unit 11*n*. The spherical unit 110 is separated into a plurality of levels. For example, in some embodiments, the unit 110 has between three and four levels. In some embodiments, the unit 110 has between four and six levels. In some embodiments, the unit 110 has between six and eight levels (e.g., seven levels). Referring now to FIG. 1., the spherical unit 110 comprises five levels. A first level 210 (e.g., near the top end 111 of the unit 110) is atop a second level 220, which is atop a third level 230, which is atop a fourth level 240, which is atop a fifth level 250 (e.g., near the bottom end 112 of the unit 110). In some embodiments, the top end 111 of the unit 110 and/or the bottom end 112 of the unit 110 are also levels. In some embodiments, each level is itself a hollow disk construction with a top, a bottom and sides. The bottom is to support miniature environments, such as buildings, trees, tunnels, etc. (see FIG. 11). The sides are to enclose each level.

In some embodiments, the present invention features a toy space station comprising a generally hollow spherical unit, wherein the spherical unit is assembled from a plurality of levels. The levels are interconnected via an interconnecting mechanism and are detachable from each other. The levels are generally circular flat disk shaped and are generally hollow. The landing gear assembly comprises four legs pivotally attached to the unit near the front end (or bottom end). The leg of the landing gear is operatively connected to a motor that can draw in the leg towards the unit or extend the leg away from the unit. The motor may be operatively connected to an on/off switch and a power source such as a battery.

Figure 10:
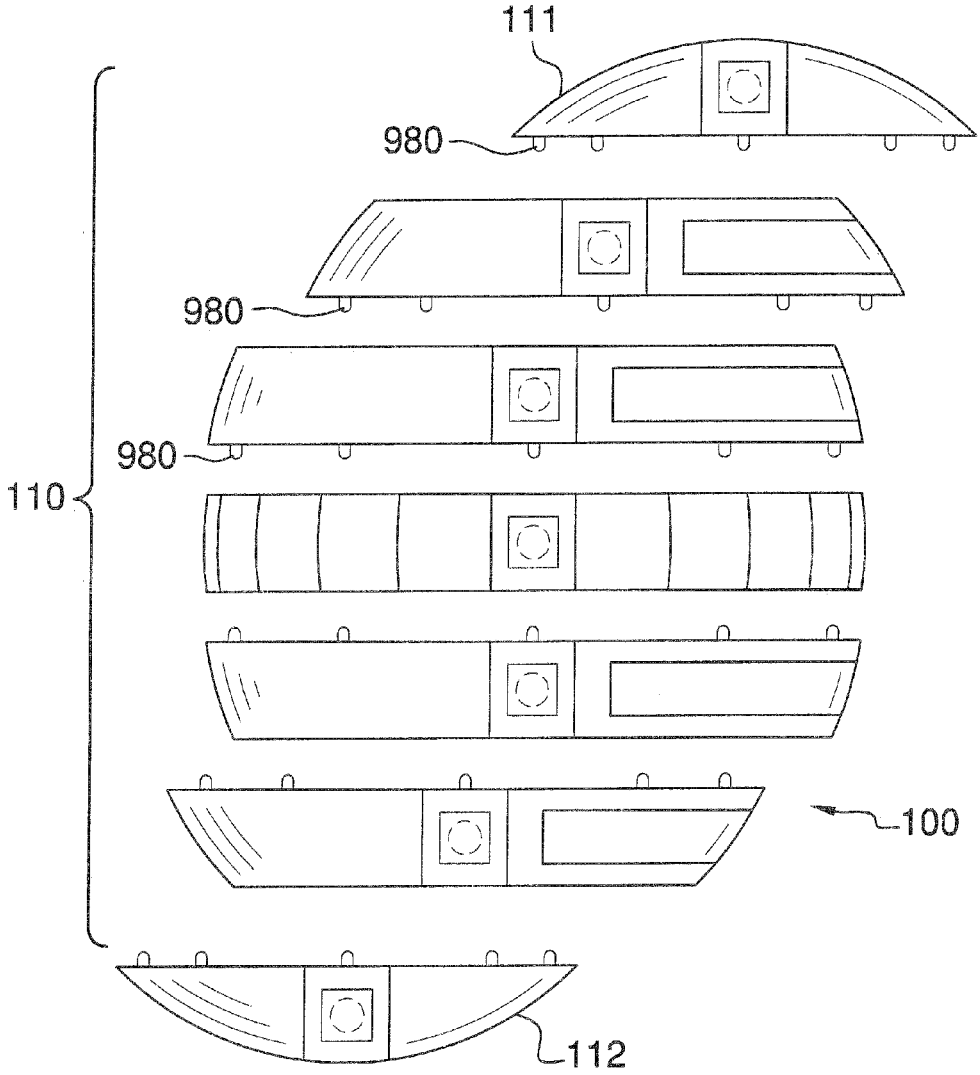
FIG. 10 is an exploded view of the toy of the present invention.

In some embodiments, the levels can rotate about an axis, for example the axis from the top end of the unit 110 to the bottom end of the unit 110. In some embodiments, the levels are detachable from each other (see FIG. 10). In some embodiments, the levels can be interconnected via an interconnecting mechanism. The interconnecting mechanism may include but is not limited to a snap (docking-locking bolt) mechanism, a hook mechanism, or the like. For example, one or more protrusions 980 may be constructed on a first level (e.g., on the bottom of the outer edge) that is for inserting into a protrusion aperture disposed on a second level (e.g., on the top of the outer edge).

The levels may be generally hollow. In some embodiments, one or more shields 140 (e.g., windows) are constructed in the levels. The shields 140 (e.g., windows) may be retractable. One or more doors 150 may be constructed on a portion of a level that can move (e.g., pivot, fold, slide, etc.) between an open position and a closed position respectively allowing and preventing access inside the level.

Figure 2:
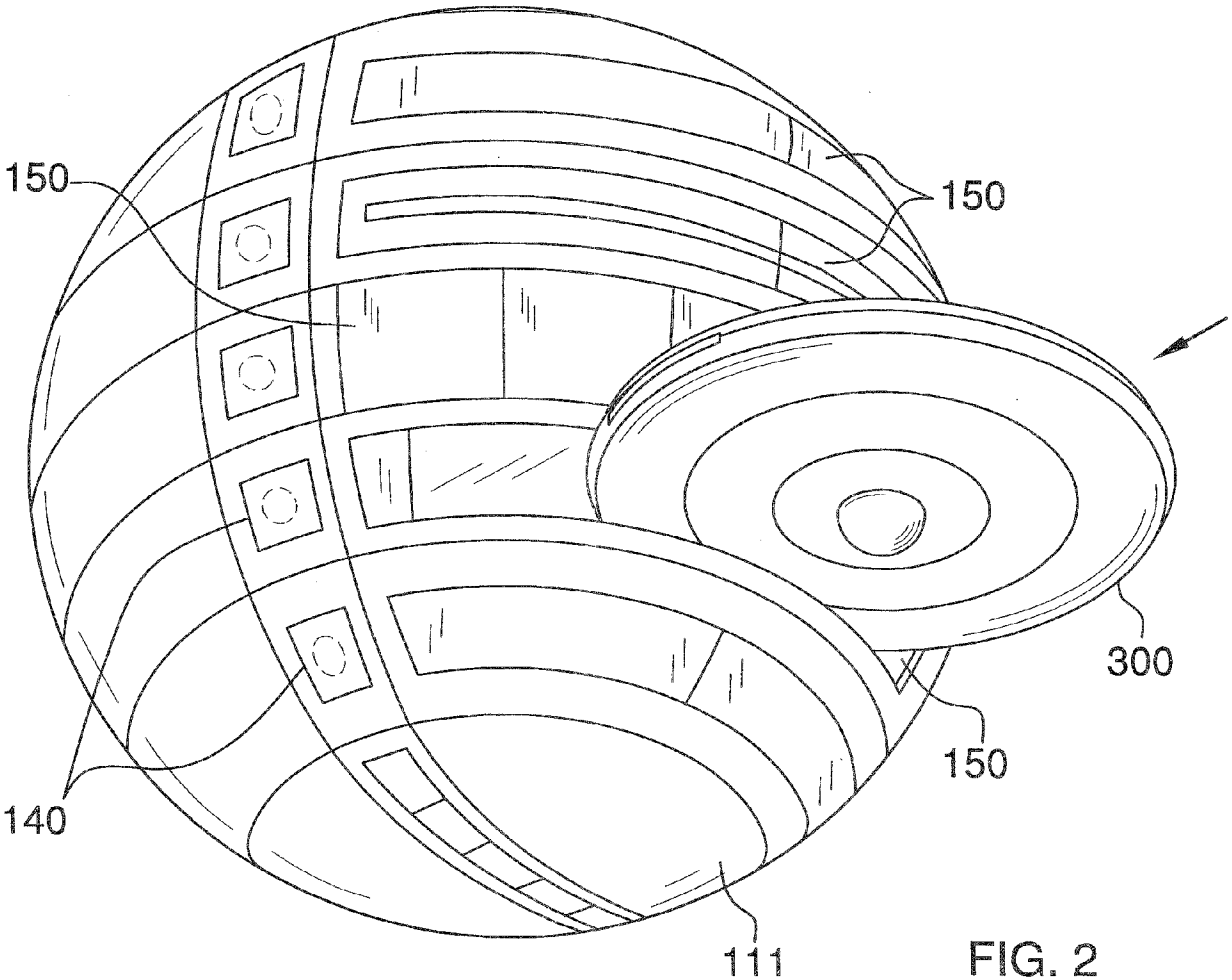
FIG. 2 is a second (bottom) perspective view of the space station toy of FIG. 1., wherein the first spaceship is removed.
Figure 3A:
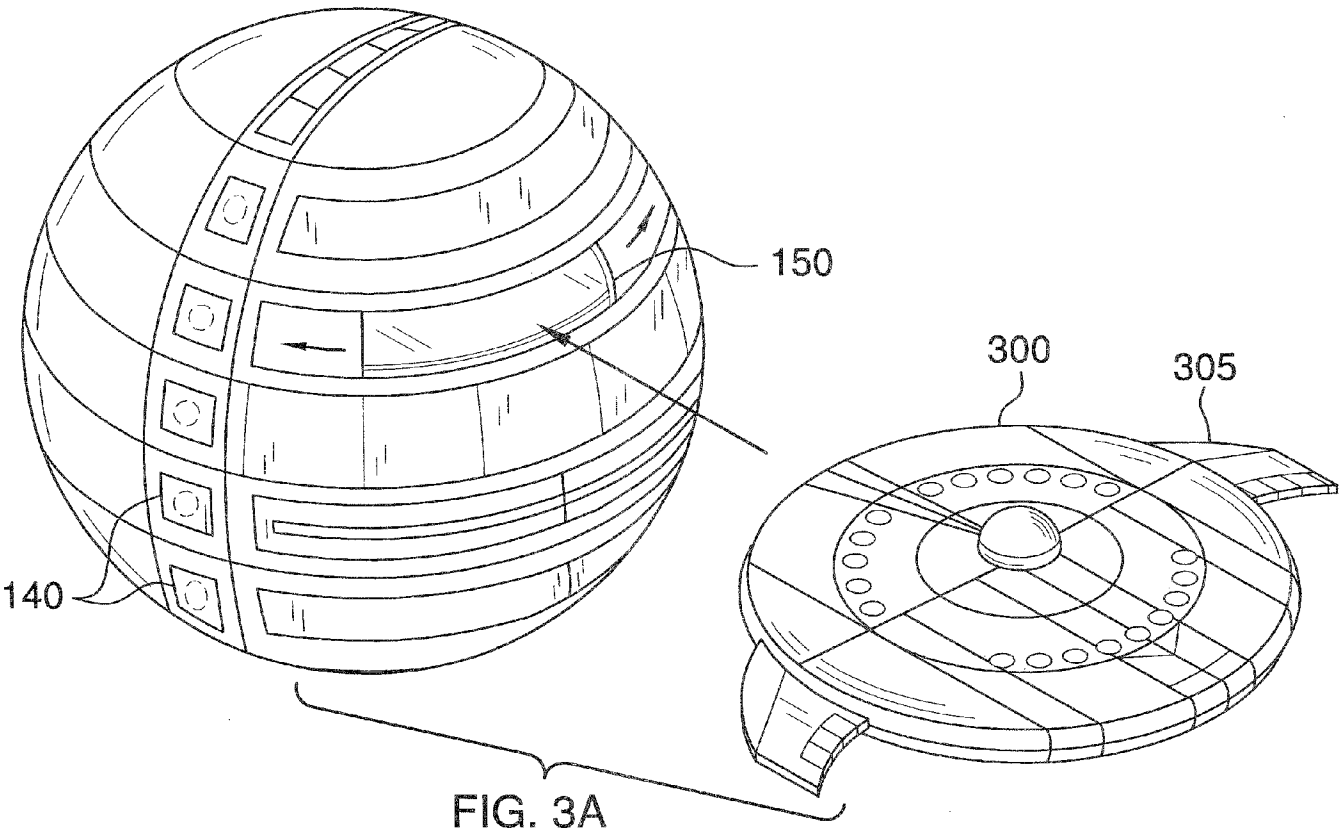
FIGS. 3A-3D are perspective views of the toy of the present invention.
Figure 3B:
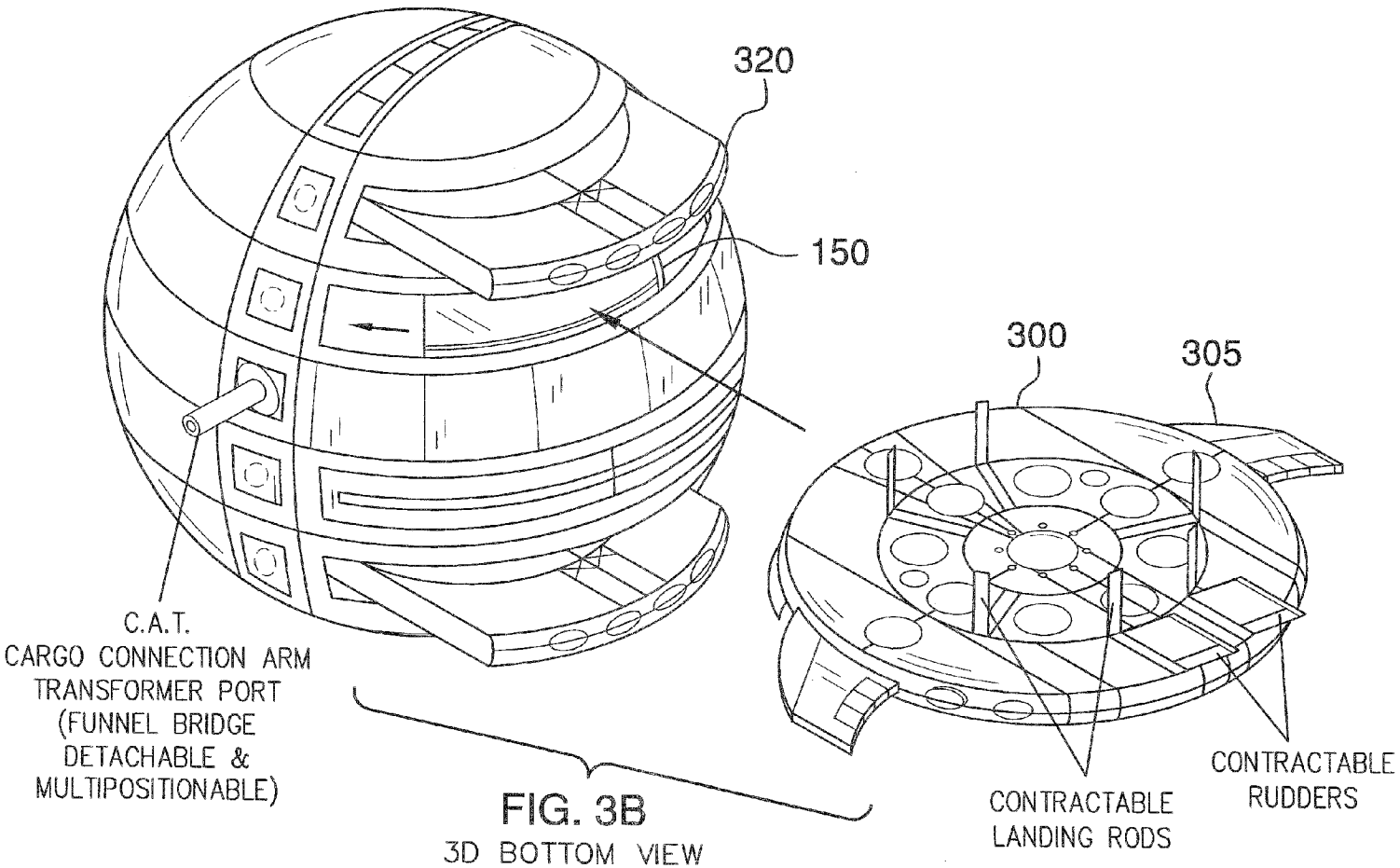
Figure 3C:
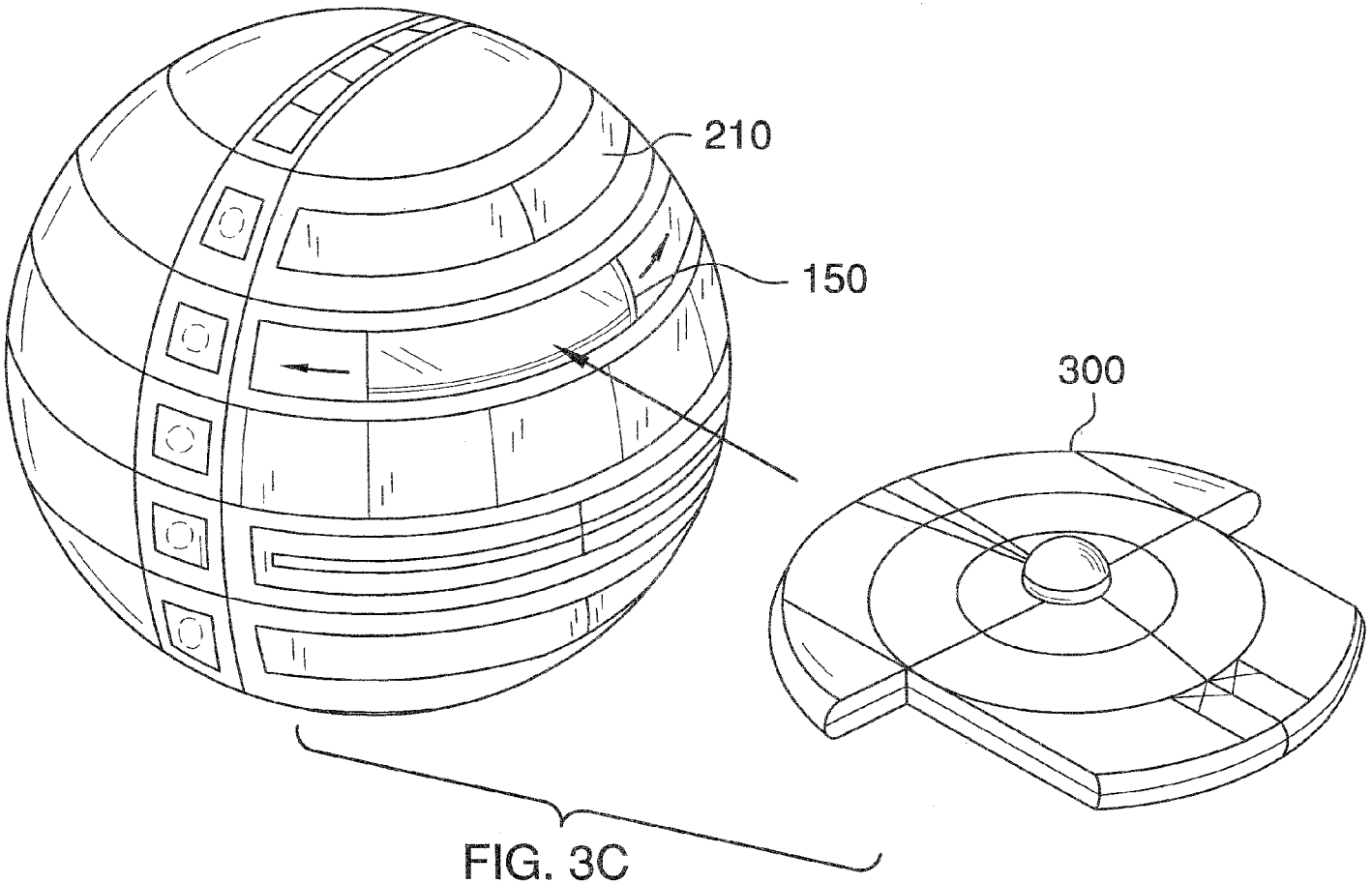
Figure 3D:
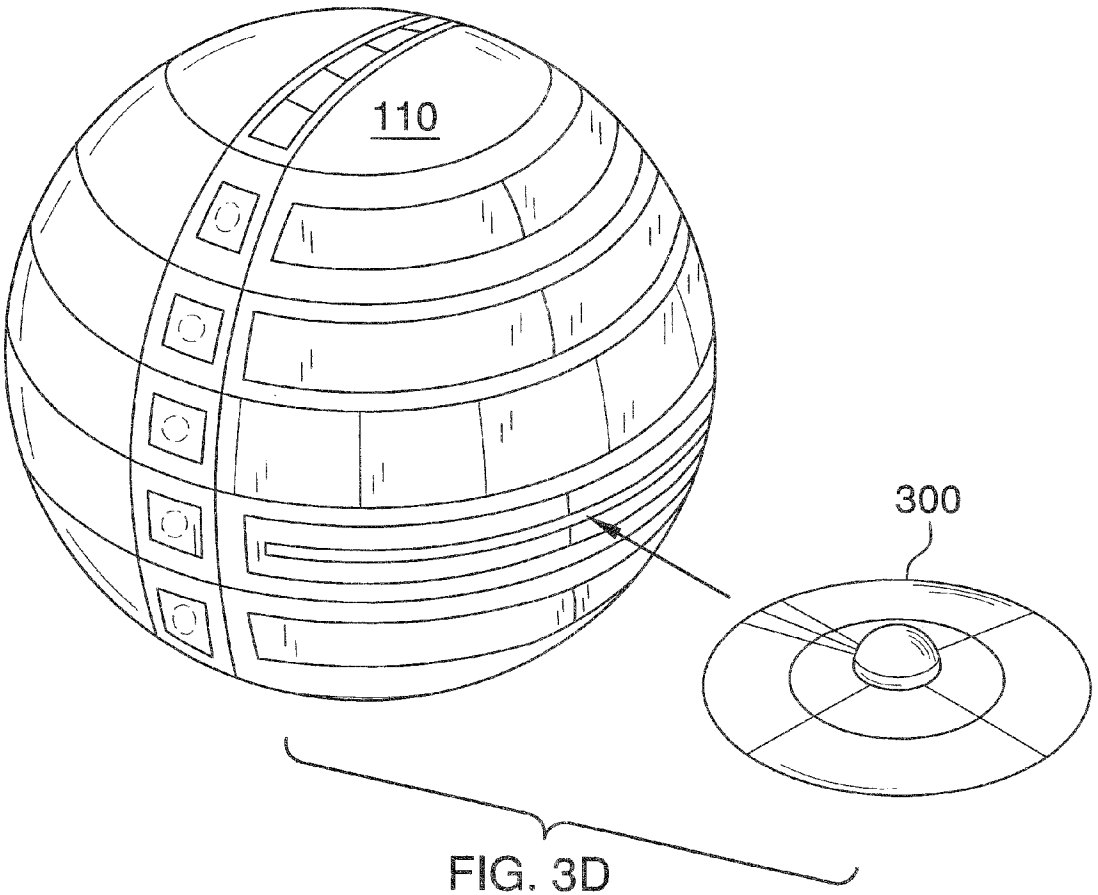

In some A.G.E.S. WORLDS, the toy 100 further comprises a removable first spaceship 300. Referring now to FIG. 2, the first spaceship 300 may be in the shape of a disk. The first spaceship 300 may be labeled "A.C.T.S. CARRIER." The first spaceship 300 may be (transformable) insertable into one or more levels. For example, as shown in FIG. 2, the first spaceship 300 is insertable into the second level 220 (e.g., via a door 150). The first spaceship 300 may have two or more contractable wings 305 and landing leg panels, with wheels contractable, V.T.O.L. (vertical take off and landing) and jet engineering systems.

In some A.G.E.S. WORLDS, the toy 100 further comprises a removably second spaceship 320. The second spaceship 320 may be insertable into one or more levels. For example, as shown in FIG. 3, the second spaceship 320 is insertable into the first level 210. Each A.G.E.S. WORLDS toy 100 level has its own A.C.T.S. carrier diskship platform.

Figure 4:
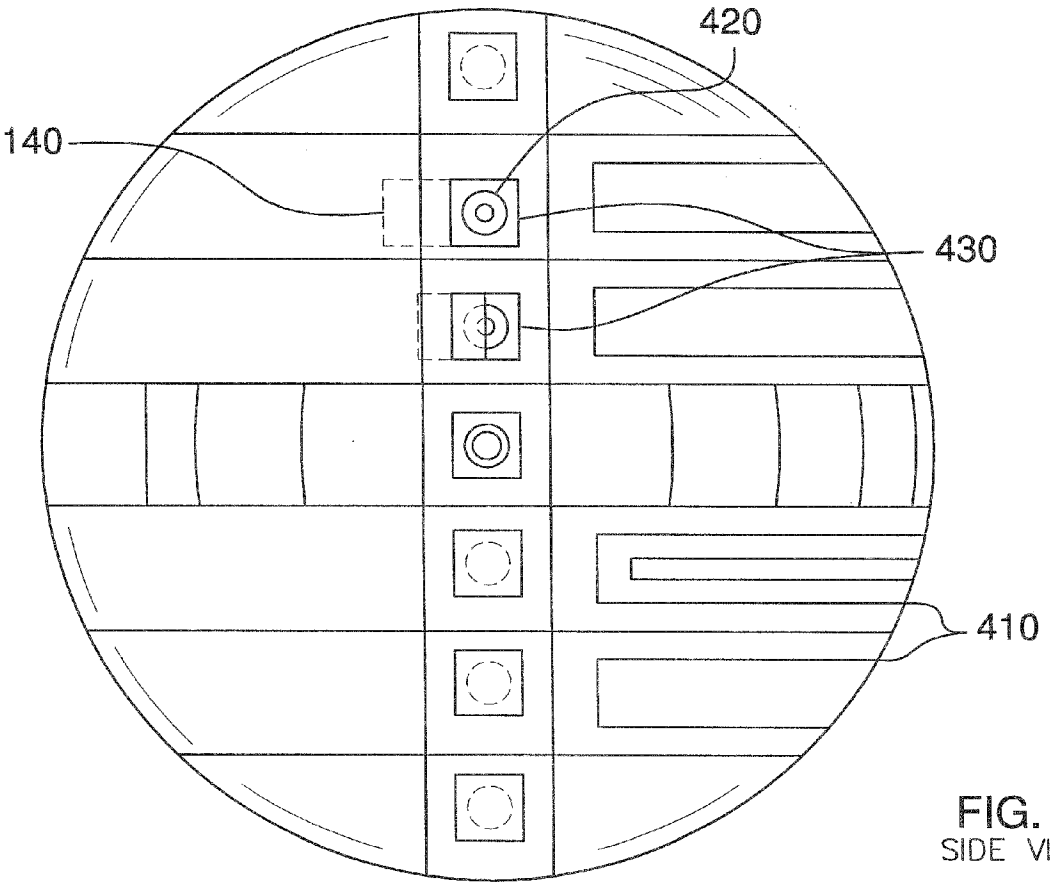
FIG. 4 is a side view of the toy of the present invention.
Figure 5:
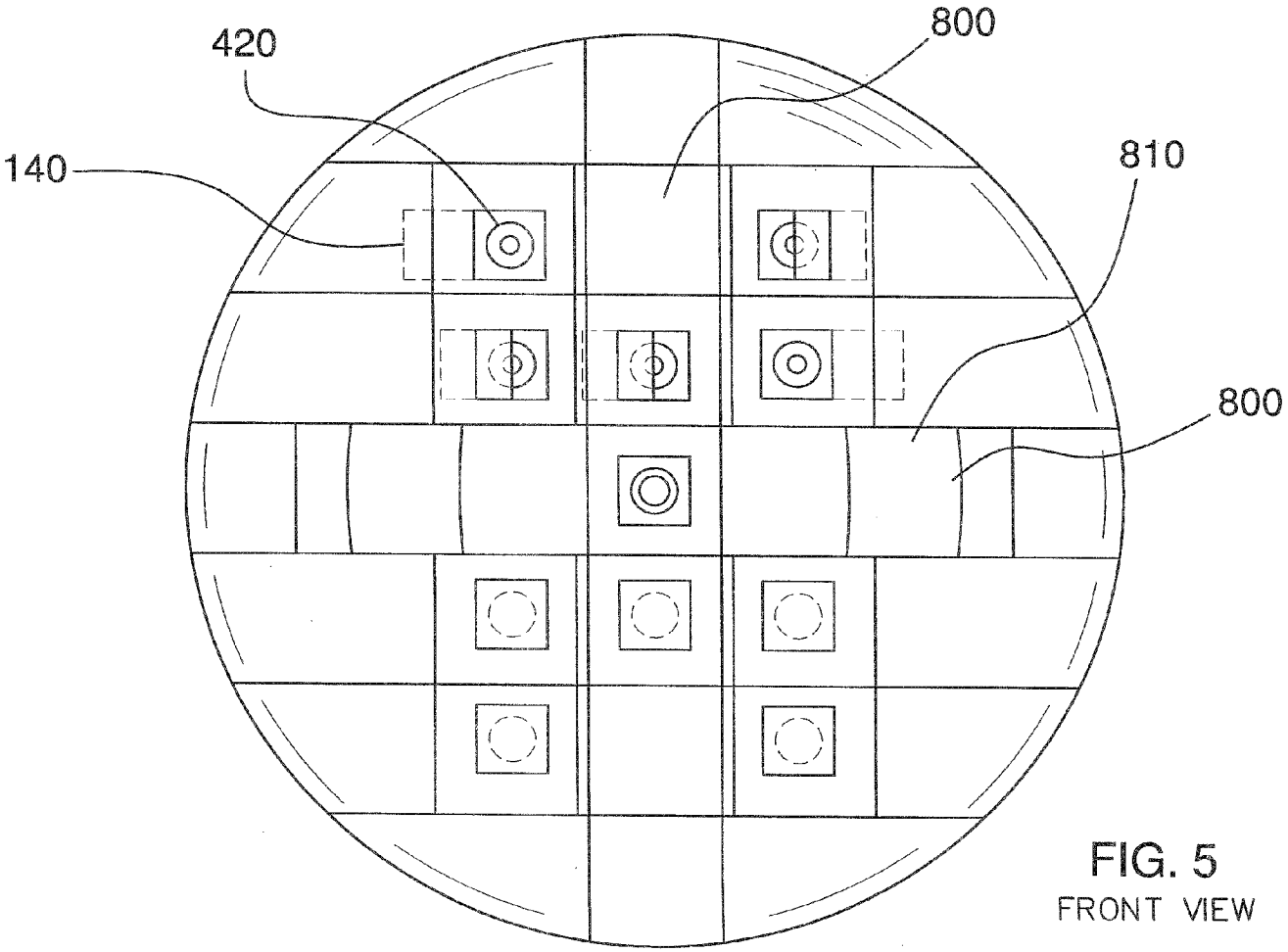
FIG. 5 is a front view of the toy of the present invention.
Figure 6:
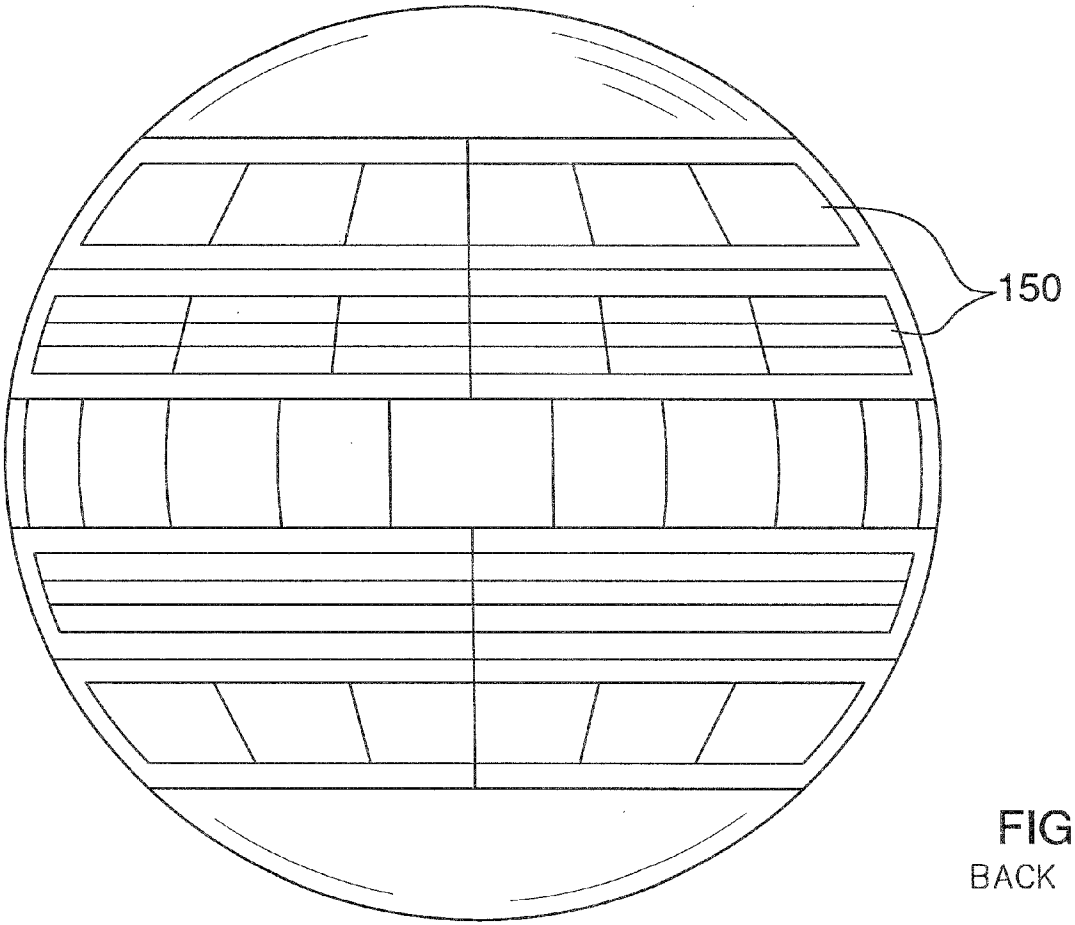
FIG. 6 is a back view of the toy of the present invention.
Figure 7A:
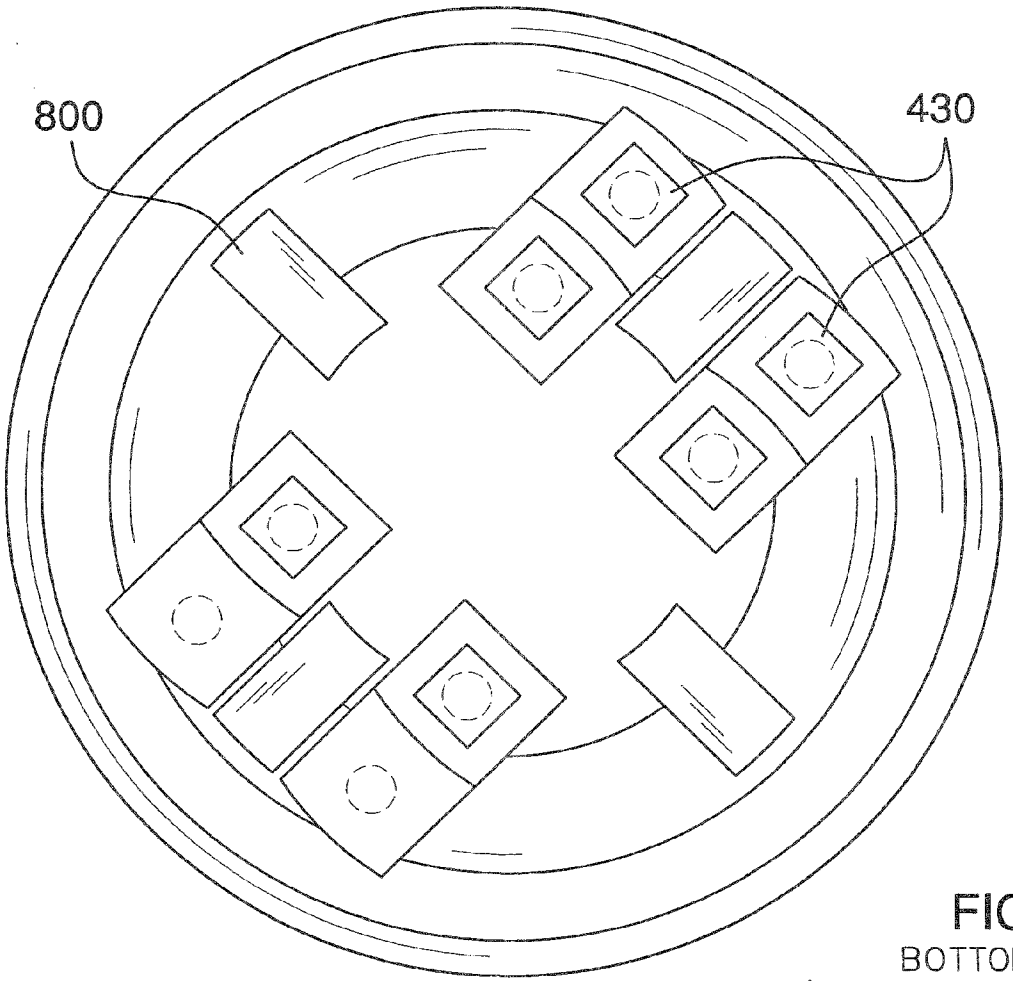
FIG. 7A-7B are bottom views of the toy of the present invention.
Figure 7B:
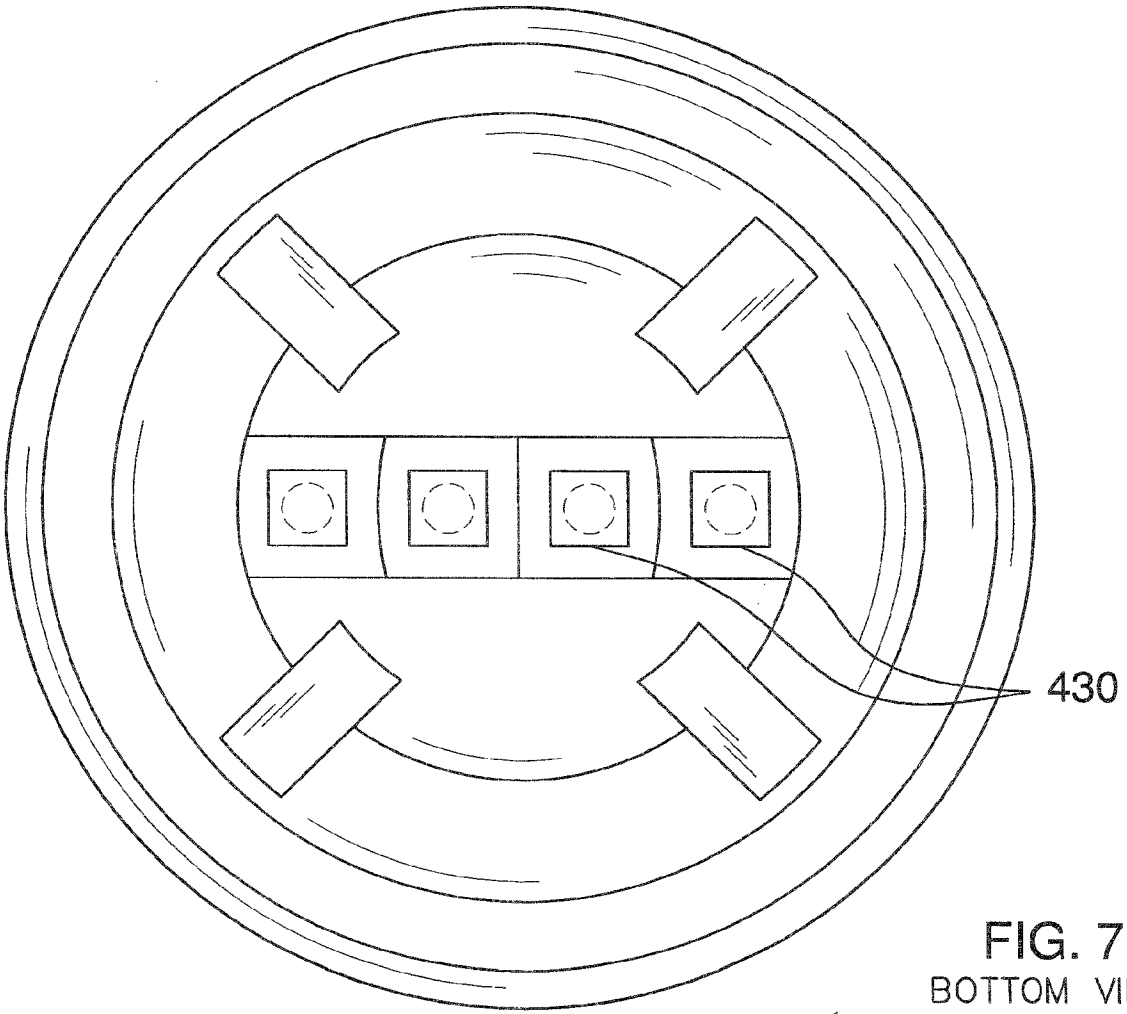
Figure 8:
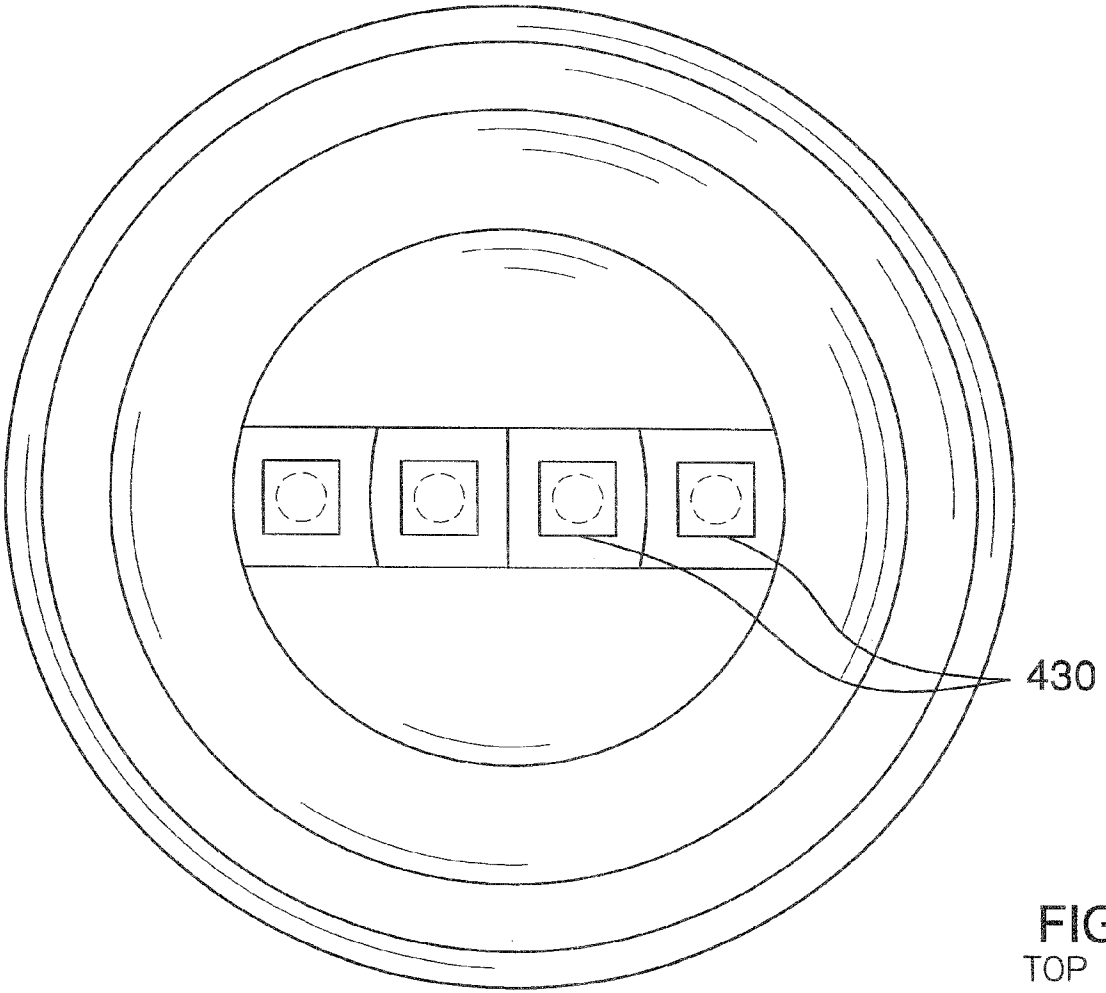
FIG. 8 is a bottom view of the toy of the present invention.

Referring now to FIG. 4, one or more lights 410 may be constructed on the unit 110. The lights 410 may be operatively connected to a power source (e.g., a battery). In some embodiments, one or more jets 420 and/or jet packs 430 are constructed in one or more levels. In some embodiments, the jets 420 and/or jet packs 430 may be accessed via windows 140.

The U.S.E.R.C.A.A. C.O. A.G.E.S. WORLD, A.C.T. section jets provide 360 degree rotational navigational major thrust power for traveling #320. The jet packs provide minor navigation thrust power for traveling. The top jet packs provide navigation down, the bottom lift up, the left side, Jet packs push right, etc. The right side jet packs push the ship to the left.

Figure 9:
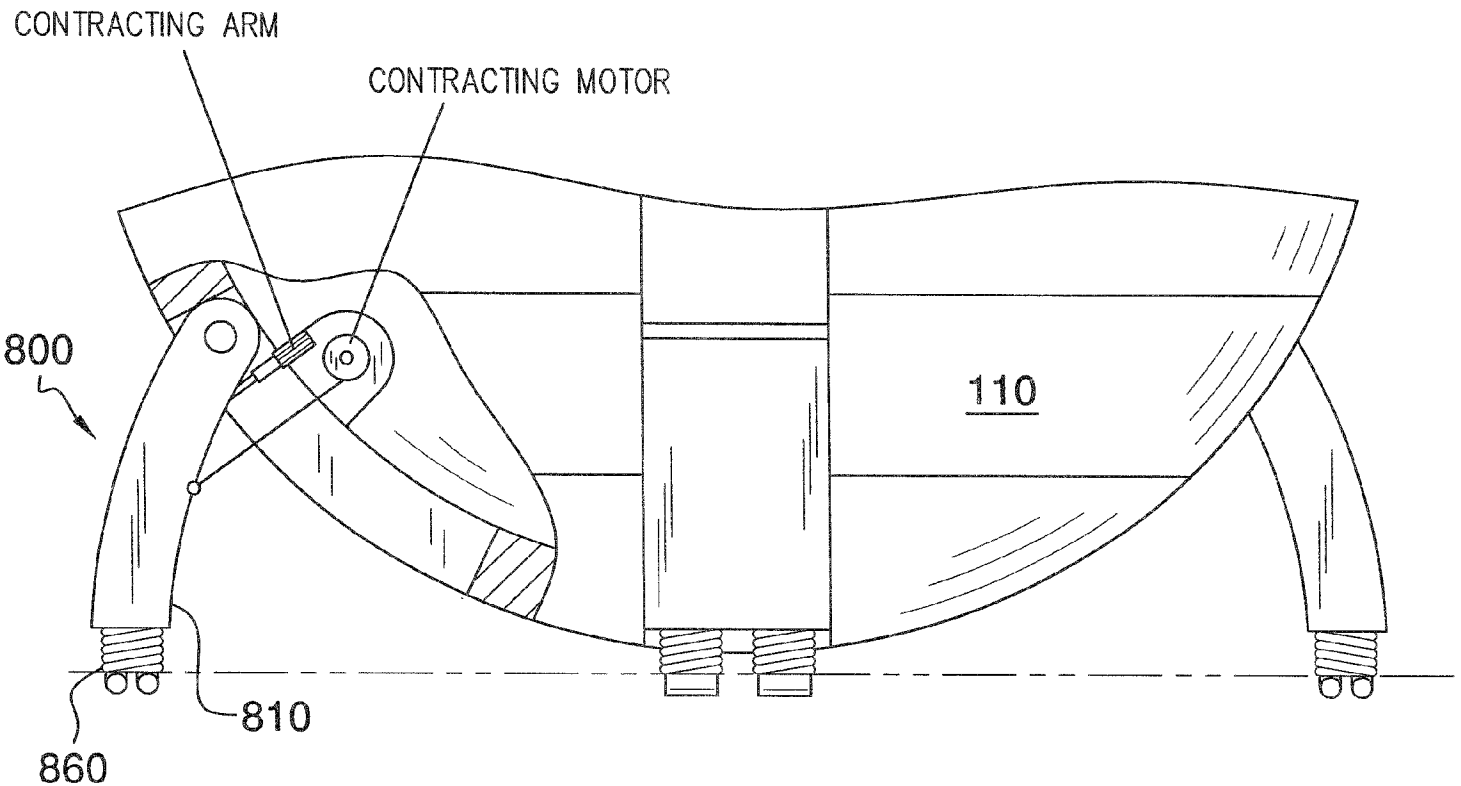
FIG. 9 is a side view of the toy of the present invention.

Referring now to FIG. 9, the unit 110 may comprise a landing gear assembly 800, for example disposed at or near the bottom end of the unit 110. In some embodiments, the landing gear assembly 800 comprises four or more legs 810 pivotally attached to the unit 110 near the front end. The legs 810 may be locked in an out position or folded into the unit 110 to an in position. In some embodiments, the legs 810 are further operatively connected to the unit 110 via a cable 820. In some embodiments, a motor operatively connects to the cable and draws in the cable to draw in the legs 810. In some embodiments, a spring 860 or a wheel is disposed on the end of the legs. The landing assembly is in the front.

The space station toy 100 of the present invention may be highly detailed. In some embodiments, a plurality of society components is disposed inside one or more levels of the unit 110. The society components allow the interior of the levels of the unit 110 to resemble societies developed in the future. In some embodiments, the components include trees, buildings, living quarters, cars, trains, people, the like, or a combination thereof.

The space station toy 100 of the present invention may be constructed from a variety of materials. For example, in some embodiments, the space station toy 100 is constructed from a material comprising plastic, metal, rubber, wood, the like, or a combination thereof.

The space station toy 100 of the present invention may be constructed in a variety of sizes and design types. In some embodiments, the spherical unit 110 is between about 4 to 8 inches in diameter. In some embodiments, the spherical unit 110 is between about 8 to 12 inches in diameter. In some embodiments, the spherical unit 110 is more than about 16 inches in diameter.

As used herein, the term "about" refers to plus or minus 10% of the referenced number. For example, an embodiment wherein the spherical unit 110 is about 10 inches in diameter includes a unit 110 that is between 9 and 11 inches in diameter.

The following the disclosures of the following U.S. Patents are incorporated in their entirety by reference herein: U.S. Pat. No. 6,723,025; U.S. Pat. No. 4,612,741; U.S. Pat. No. 5,326,328; U.S. Pat. No. 6,540,580; U.S. Pat. No. 5,310,375.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. The scope of the invention is not limited to toys but to include real estate housing design, interior decorating bread toaster, gumball machine, etc.

What is claimed is:

1. A toy artificial planet space station comprising (a) a generally hollow spherical unit, wherein the spherical unit is assembled from a plurality of levels, the levels are interconnected via an interconnecting mechanism and are detachable from each other, the levels are generally circular flat disk shaped and are generally hollow, and with an aquatic avionic continental transformer port circular disk shapes inside on each detachable planet hollow level; and (b) a landing gear assembly comprising four legs pivotally attached to the unit near the front or bottom end, the leg of the landing gear is operatively connected to motor that can draw in the leg towards the unit or extend the leg away from the unit; and wherein one or more shields (windows) are disposed on the levels, optionally containing jet engineering system, wherein the shields are retractable, wherein one or more doors disposed on a portion of a level that can move between an open position and a dosed position respectively allowing and preventing access inside the level and providing jet engineering systems navigation.

2. The toy of claim 1 wherein the levels can rotate about an axis from a top end of the unit to a bottom end of the unit.

* * * * *